US008944872B2

(12) United States Patent
Hill et al.

(10) Patent No.: US 8,944,872 B2
(45) Date of Patent: Feb. 3, 2015

(54) SURFBOARD FIN FOR GENERATING SURFBOARD LIFT AND METHOD OF USE

(71) Applicants: Mark Aaron Hill, Raleigh, NC (US); Andrew Steven Hill, Raleigh, NC (US)

(72) Inventors: Mark Aaron Hill, Raleigh, NC (US); Andrew Steven Hill, Raleigh, NC (US)

( * ) Notice: Subject to any disclaimer, the term of this patent is extended or adjusted under 35 U.S.C. 154(b) by 0 days.

(21) Appl. No.: 14/025,993

(22) Filed: Sep. 13, 2013

(65) Prior Publication Data

US 2014/0080371 A1 Mar. 20, 2014

Related U.S. Application Data

(60) Provisional application No. 61/701,715, filed on Sep. 16, 2012.

(51) Int. Cl.
*B63B 1/00* (2006.01)
*B63B 35/79* (2006.01)
*B63B 1/24* (2006.01)

(52) U.S. Cl.
CPC ..... *B63B 35/7923* (2013.01); *B63B 1/248* (2013.01); *B63B 35/7926* (2013.01)
USPC ..... 441/79; 441/74; 114/288

(58) Field of Classification Search
USPC ..... 441/79, 74; 114/288
See application file for complete search history.

(56) References Cited

U.S. PATENT DOCUMENTS 6,739,925 B2 * 5/2004 Burns et al. ..... 441/79
2014/0080371 A1 * 3/2014 Hill et al. ..... 441/79

* cited by examiner

*Primary Examiner* — Lars A Olson
*Assistant Examiner* — Jovon Hayes
(74) *Attorney, Agent, or Firm* — Cranfill Summer & Hartzog

(57) ABSTRACT

The present invention relates to a lifted fin apparatus comprising one or more lifted fin elements with foiled tin components for a reduction of pressure and drag and an increase in surfboard lift as well as a method of achieving surfboard lift through, the use of said apparatus. Generally, the lifted fin apparatus comprises two or more lifted fin elements exhibiting a foil design on one or more of the fin surfaces. The individual fin elements may comprise a substantially vertical fin attached to a first edge of a base member and oriented at a substantially 90° angle in relation to the bottom surface of the surfboard or to the first edge of the base member. The fin elements may further comprise an angular fin mounted to a second edge of the base member at one end and the lower portion of the first, fin at the other end. In said embodiment, a bend or elbow is formed between a first fin component of angular fin and base member proximate the point of attachment at second edge of base member. Alternatively, the base member may not have a defined second edge representing the intersection between base member and a first fin component of angular fin, but rather the base member and the angular fin may be manufactured as a unitary structure with a bend or elbow between base member and a first fin component as described below.

19 Claims, 6 Drawing Sheets

SURFBOARD FIN FOR GENERATING SURFBOARD LIFT AND METHOD OF USE

RELATED APPLICATIONS

This application claims priority to U.S. Provisional Patent Application Ser. No. 61/701,715 filed Sep. 16, 2012. The disclosure of U.S. Provisional Patent Application 61/701,715 is incorporated by reference herein in its entirety.

FIELD OF THE INVENTION

The invention relates generally to surfboards and more particularly to hydrodynamic fins mounted underneath a surfboard and methods of using the same to achieve surfboard lift.

BACKGROUND OF THE INVENTION

Surfboards may generally be described as water planing devices used to ride waves. The term "surfboard" may include boogie boards, wind surfing boards, and other hulled craft which are maneuvered by shitting the weight borne by the craft relative to the craft's center of gravity. Surfboards may be constructed of various lengths, width, shapes and thicknesses. Initially, surfboards had a single vertical fin located along the centerline of the surfboard at the rear that provided directional stability. Later designs added additional smaller fins of various sizes and shapes along the sides of the surfboard to improve the stability and maneuverability of the surfboards.

In terms of its design, a surfboard fin is analogous to a "fixed wing." The surface curvature of conventional fins reflects architecture similar to that of a "fixed wing" aircraft. When the physics are applied to an aqueous environment, the "fixed wing" is termed a "hydrofoil" or sometimes simply a "foil."

Holding all other variables constant and for a constant hydrofoil speed, the velocity of water passing over the top surface of the hydrofoil wing is greater than that which passes below the flat bottom surface. With an increase in water velocity over the top of the hydrofoil wing, the pressure of the water over this surface is reduced when compared to the pressure below the hydrofoil wing. This difference in pressure tends to push the hydrofoil wing toward the side of lowest pressure of the pressure gradient. The velocity of the water over the top surface of the wing is forced to rise with increased velocity because (a) water is essentially incompressible and (b) the distance a water molecule must travel for a given linear distance is longer due to the curvature of the wing over the hydrofoil surface as compared to the straight line distance enjoyed by water molecules passing below the hydrofoil wing. The upward force generated through relative motion between the wing and the environment through which it travels, in this case water, is proportional to the velocity of the water over the wing surfaces and the surface area of the wing's bottom surface. The velocity of a surfboard is largely a function of wave height, wave velocity, and gravity.

A reduction in lift may be expected from "turbulence" or "cavitation" that could theoretically develop over the wing surface. For example, turbulence may be created by high surface friction coefficients and disrupt desired laminar flow. Cavitation is a phenomenon whereby gasses actually come out of solution in the surrounding water mass due to significant pressure reduction. Similar to opening a carbonated beverage, and under the appropriate temperature and pressure conditions, air bubbles may form in the low pressure zones over the wing's surface. Cavitation may disrupt laminar flow and will also produce aquatic sounds as the bubbles collapse and return to solution.

The single vertical fin is generally speaking, a type of hydrofoil, whose function is to provide lift or some other force to the surfboard in reaction to its motion through the water. The single vertical fin is usually a symmetrical foil (a "50/50" foil) with both sides convex, which provides for even water flow on both sides of the fin such that a single vertical fin promotes stability and control. If the hydrofoil has a convex, top surface and a flat bottom surface, the velocity of water flow over the top surface of the hydrofoil is increased, thus creating a water pressure differential between the bottom and top surfaces and producing Sift or thrust in the direction of the pressure differential toward the area of lowest pressure.

The performance of a surfboard is affected by the design, placement, and number of fins affixed to the surfboard. For example, a fin may be defined by its dimensions: its base, its depth, its sweep, its flex, and its cant, and changes in these dimensions affect the performance characteristics of the surfboard. As for the hydrofoil effects, the fin may be the aforementioned symmetrical foil or a flat foil having one flat side and one convex side, which promotes maneuverability and fast transitions between turns. Other fins may combine the characteristics of a symmetrical foil and a flat foil in various proportions dependent on the desired performance characteristics of the surfboard. For optimum foil performance, flexibility in design characteristics is necessary, as well as the ability to modify these design characteristics as surfing conditions change.

Therefore, as competitive surfers attempt more challenging maneuvers and ride bigger waves, there is need for improved fin designs that improve the lift, maneuverability, and other performance characteristics of the surfboards.

SUMMARY OF THE INVENTION

The present invention relates to a lifted fin apparatus comprising one or more lifted fin elements with foiled fin components for a reduction of pressure and drag and an increase in surfboard lift as well as a method of achieving surfboard lift through the use of said apparatus. In some embodiments, said individual lifted fin elements may be combined into a single unitary structure embodying the physical characteristics of a combination of two or more fin elements.

In some embodiments, the lifted fin apparatus of the present invention comprises two or more lifted fin elements. Lifted fin elements may further comprise at least two fins exhibiting a foil design on one or more of the fin surfaces. In some embodiments, the at least two fins may comprise a substantially vertical fin attached to a first edge of a base member and oriented at a substantially 90° angle in relation to the bottom surface of the surfboard or to the first edge of the base member. The at least two fins may further comprise an angular fin mounted to a second edge of the base member at one end and the lower portion of the first fin at the other end. In said embodiment, a bend or elbow is formed between a first fin component of angular fin and base member proximate the point of attachment at second edge of base member. Alternatively, the base member may not have a defined second edge representing the intersection between base member and a first fin component of angular fin, but rather the base member and the angular fin may be manufactured as a unitary structure with a bend or elbow between base member and a first fin component as described below.

In some embodiments, the second angular fin comprises at least two fin components, a first fin component and a second fin component, with a bend or elbow between first fin component and second fin component and a bend between first fin component and base member (as described above) wherein the first tin component extends downward from the second edge of the base at an angle of 17.99° from the substantially vertical, fin for a specified length and the second fin component extends downward at an angle of 72.10° until the second angular fin reaches and is attached to the substantially vertical fin. The angular design of the second angular fin and engagement to a second edge of base member and lower portion of the substantially vertical fin yields a box design in some embodiments. In some embodiments, the lead opening of the box is larger than the rear opening resulting in a Venturi effect.

In some embodiments, the second angular fin may be attached to the first substantially vertical fin at an angle to redirect water downward through the box design—thereby generating lift. To achieve this effect, in some embodiments, the second fin is attached at a 5° declined plane in relation to the plane of the water surface on which the surfboard rides.

In some embodiments, at least one surface of the first ("substantially vertical") and second ("angular") fins is foiled. For example, in one embodiment the exterior surface of first fin or the surface facing the outside (lateral) edges of the surfboard is convex, in another embodiment, the upper or interior face of the lower portion, of said second fin is convex. And in yet another embodiment, both interior faces of said second fin. (e.g., interior faces of the first fin component and the second fin component) are hydrofoils (e.g. convex). In some embodiments, the length between the leading edge of the first and second fins to the nearest point of maximum thickness is a predetermined length, for example, about 0.25" and the length between the rear edge of the first, and second fins and the thickest part of the fin is also a predetermined Length, for example, about 1.5".

The foregoing and other features, objects, and advantages of the invention will become more apparent from a reading of the following detailed description in connection with the accompanying drawings.

BRIEF DESCRIPTION OF THE DRAWINGS

Certain embodiments of the present invention can be better understood with reference to the following figures. Like reference numerals designate corresponding parts throughout the different views.

DESCRIPTION OF THE REPRESENTATIVE EMBODIMENTS

Further scope of applicability of the present invention will become apparent from the description of representative embodiments given herein. However, it should be understood that the description and specific examples, while indicating embodiments of the invention, are given by way of illustration only since various changes and modifications within the spirit and scope of the invention will become apparent to those skilled in the art.

Figure 1:
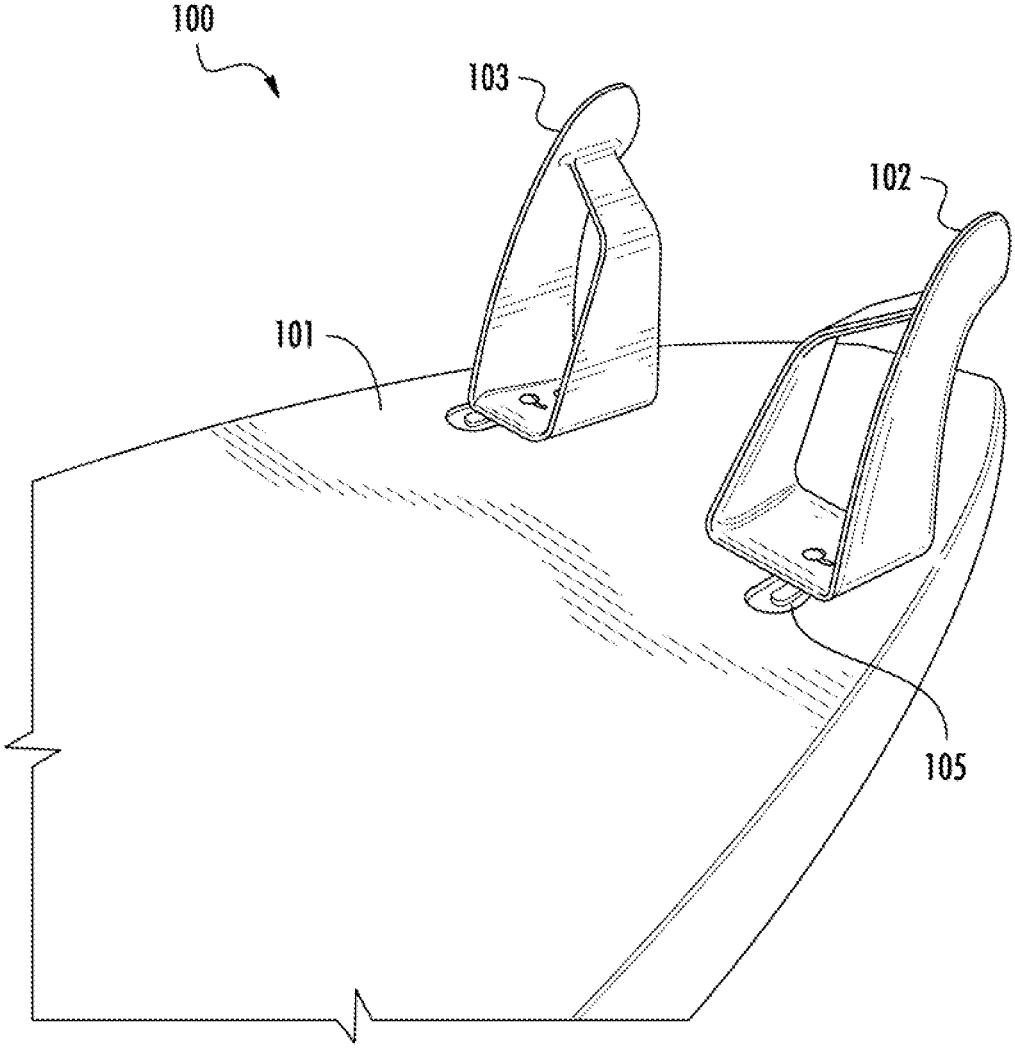
FIG. 1 shows a perspective view from underneath a surfboard with two lifted fins mounted on the bottom of the surfboard at the rear.

FIG. 1 is a perspective view 100 of the lifted fin apparatus from underneath a surfboard 101 with two lifted fin elements 102, 103 mounted to the bottom of the surfboard 100 at the rear. In this embodiment, lifted fin element 102 is designed to be affixed to the left side of a surfboard and lifted fin element 103 is designed to be affixed to the right side of a surfboard in accordance with the invention (the designations left and right are from the standpoint of a rider standing on the surfboard facing in the direction of travel). The embodiments illustrated in the figures disclose two lifted fin elements 102, 103 affixed to the surfboard 101 but one of ordinary skill in the art will recognize that the physical and functional principles embodied by the double fin element design may be accomplished by combining said properties into a single unitary structure. It should also be recognized that a user may affix more than two lifted fin elements at various positions on the underside of a surfboard or the user may affix a single lilted fin element to the underside. Alternatively, a user may mount a single lifted fin element to the underside of the surfboard if desired.

Figure 6A:
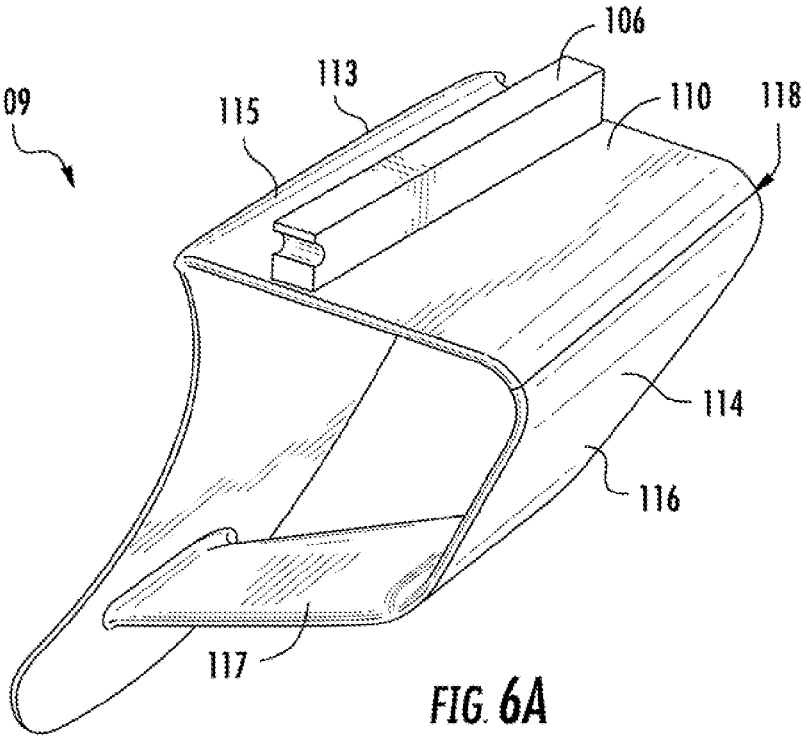
FIG. 6A shows a rear view of the lifted, fin shown in FIG. 2 with the rib attachment assembly.
Figure 6B:
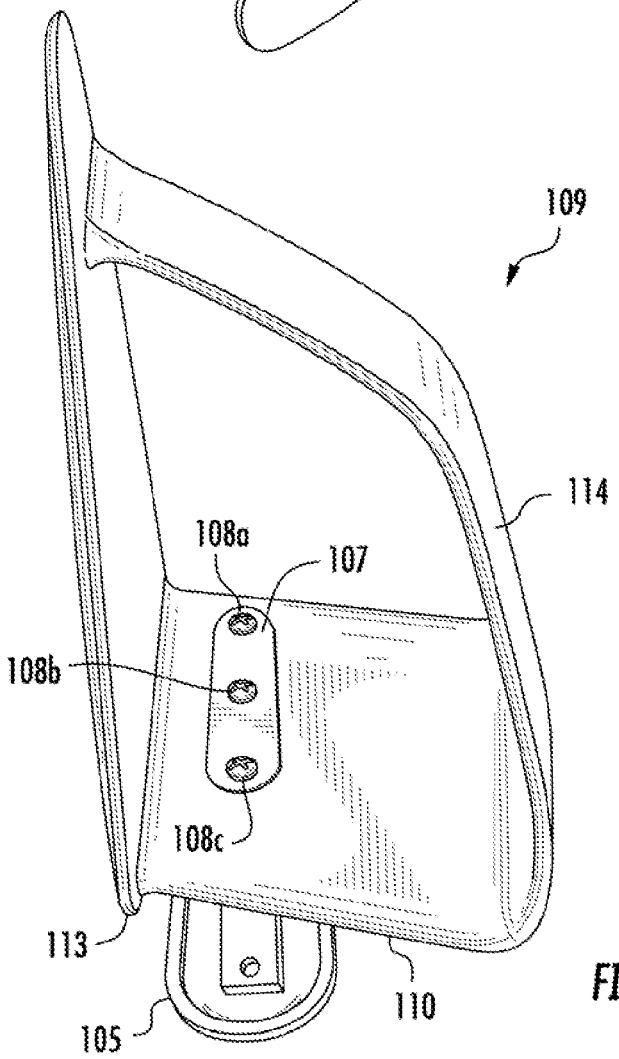
FIG. 6B shows a bottom view of the lifted fin shown in FIG. 2 illustrating the bracket affixing the rib attachment assembly.

Lifted fin elements 102, 103 are mounted to the surfboard 101 by means of a plug system 105. Plug 105 may be a long, thin piece of high-density plastic or aluminum with a plurality of threaded mounting holes on its bottom surface, which accept machine screws attaching the lifted tin elements 102, 103. The plug may be may be built, into the surfboard as is the case today with most major surfboard manufacturers and held in place either with an angled grub screw, or other methods. Other lifted fin attachment mechanisms are equally suitable for the purposes of this invention which will be readily recognized by one of ordinary skill in the art. For example, FIGS. 6A and 6B illustrate an attachment mechanism comprising plug 105 and rib 106 components, wherein rib 106 is inserted into a slot centrally and longitudinally positioned within plug 105. In this embodiment rib 106 is mounted to the surface of base member by brace 107 and screws 108*a*, 108*b*, and 108*c*.

Figure 2:
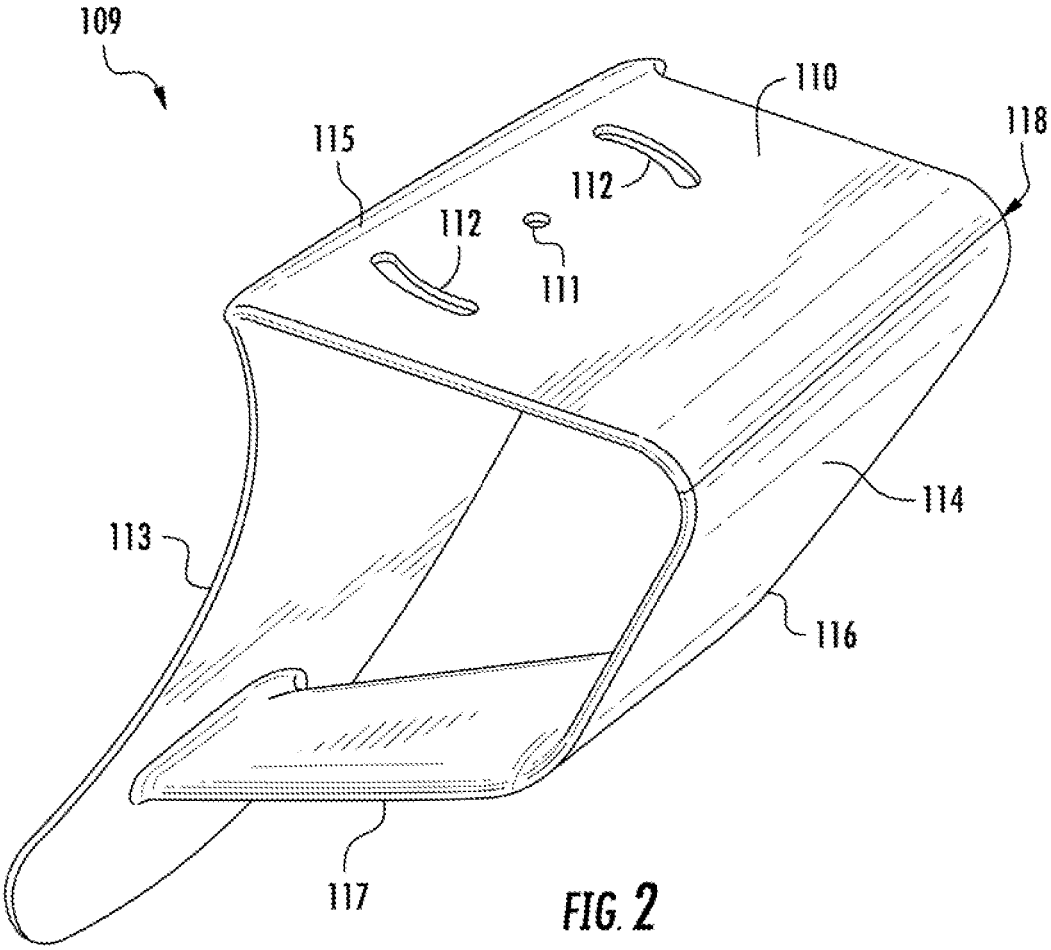
FIG. 2 shows a perspective rear view of a lifted fin to be affixed to the left side of a surfboard on its bottom surface.
Figure 3:
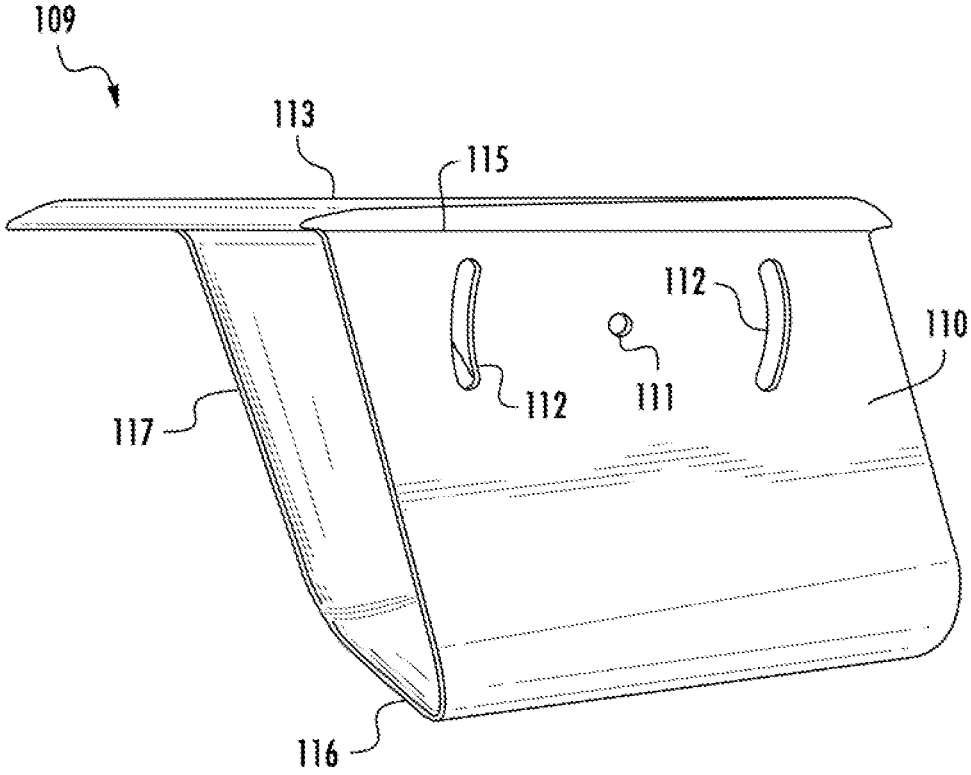
FIG. 3 shows a top view of the lifted fin shown in FIG. 2.

FIG. 2 is a perspective rear view of an embodiment of a lifted fin element 109 to be affixed to the left side of a surfboard on its bottom surface showing more details of the lifted fin element and utilizing the plug assembly mechanism without the rib. In the embodiment shown in FIGS. 2 and 3, base member 110 forms the top portion of lifted fin element 109. Base member 110 includes a central mounting hole 111, through which a machine screw passes to attach the base member 110 to plug 105, FIG. 1 which may operate as a pivot around which the lifted fin element 109 can rotate. Two additional machine screws may be used that pass through radial arc slots 112 to complete the attachment of the lifted fin element 109 to the surfboard 101.

With continued reference to FIG. 2, adjustments to the performance of a lifted fin may be made by changing the location of the lifted fin element[s] below the surfboard and by rotating the lifted fin element[s] to change "drag" by rotating the base member 110 of the lifted fin element 109 around the machine screw or other connector inserted into the plug 105. These types of "adjustments" can be particularly useful in tailoring surfboard performance characteristics to suit unique wave geometry, wind conditions, rider position and rider weight. For example, for wave heights of 30 to 40 feet, where the force of gravity tends to push the rider towards the trough of the wave, compensating for the loss of vertical position on the forward side of the wave may be accomplished by attempts to maintain a horizontal line relative to wave curl. Rotational adjustment, provided in the lifted fin mounting design, provides opportunity for the rider to make at sea changes to board drag, control the rate of descent over the wave surface, and provide valuable time in portions of wave geometry. With the advantage of enhanced wave position control, the rider has an opportunity to experience conditions that may have otherwise been too short lived to provide an opportunity for experimentation and trick development.

Referring to FIG. 2, the lifted fin elements shown comprise a first fin 113 and a second fin 114. First fin 113 is a substantially vertical fin oriented at substantially 90° in relation to the plane defined by the bottom surface of the surfboard. First fin 113 is a conventional foil. that is attached perpendicularly to a first edge 114 of the base member 110. In this embodiment, first fin 113 is a flat foil with the base member 110 affixed to the flat side of the foil at the first edge 115 of base member 110 or the "inner edge" of the base member 110 in this case. In this example utilizing a flat foil the convex side of the foil faces outward from the center of the surfboard 101 toward the lateral side of the surfboard.

Second fin 114 is also a foil and is comprised, of a first fin component and a second fin component (represented by reference numerals 116 and 117 respectively in FIG. 2). First fin component of second fin 114 extends from a second edge 118 or, in this case, the "outer edge" of the base member 110 at a specified angle from the first fin 113 for a specified length. In this embodiment, the second fin 114 bends and extends downward from a second edge 118 of base member almost parallel to the plane of the first fin 113 (at a slight angle). Second fin component 116 of second fin 114 then curves back inward toward first fin 113 and extends further downward at a specified angle to the first fin 113 and is attached to first fin 113 (see FIG. 2). In an alternative embodiment, base member 110 does not have a defined second edge 118 or "outer edge" but rather base member 110 and second fin 114 are manufactured as a unitary structure. Second fin 114 is "angular" and comprises a bend or elbow between first fin component 116 and base member 110 and an elbow between first fin component 116 and second fin component 117.

Both fin components of second fin 114 may be foils and provide additional lift vectors depending on their configuration. In the embodiment shown in FIGS. 1-5, the interior face of second fin 114 (e.g. the interior face of first fin component 116 and second fin component 117 of second fin 114) and base member 110 is a foil or is convex. In an alternative configuration, the interior face of only part of the second fin 114 is a foil, for example the second fin component 117 or the interior face of base member 110 is the only interior surface that is a foil.

By employing a foil design to one or more of the fin components of the second fin 110 and orienting the foiled fin component such that convex surface interfaces with the interior physical space of the "box frame" of the lifted fin, further pressure reduction is experienced for water passing over these surfaces. Once again, an element of design is employed to provide further pressure reduction of the water mass traveling in the vicinity of the top surface of the horizontal hydrofoil wing. With additional pressure reduction, the net result is greater effective lift.

It should be recognized that while the first and second tins shown in the figures exhibit so-called "flat" foil design, other conventional foil designs are equally applicable for the purposes of the present invention, including for example "inside" foils, 50/50 foils, 80/20 foils, and the like.

The foiled fins of the present invention have one or more convex surfaces depending on the type of foil utilized, e.g. a flat foil or 50/50 foil, etc. In the embodiment depicted in FIGS. 1-6, the length from the front edge to the nearest point of maximum thickness is a substantially uniform measurement on each fin. Another way to explain this concept is that the slope or pitch of the foiled surface extending from the front edge of the fin to the nearest point of maximum thickness is substantially uniform across the entire fin. Likewise, the length from the rear edge to the nearest point of maximum thickness on the foiled surface on each fin or the slope of the foiled surface extending from the front edge of the fin to the nearest point of maximum thickness is substantially uniform. For example, with respect to first fin 113 the length from the front edge to the nearest point of maximum thickness on the fin is about 0.25" and the length from the rear edge to the nearest point of maximum thickness is about 1.5" when measured along a lateral axis across the mid-section of said first fin 113. It should be recognized that at narrower sections of first fin 113, this length may not extend the entire 1.5". Overall, there must not be too much sharpness on the leading edge or the rear edge of the fin or else it may cavitate. The aforementioned measurements were determined to provide the best overall performance; however, other dimensions are also suitable.

Figure 4:
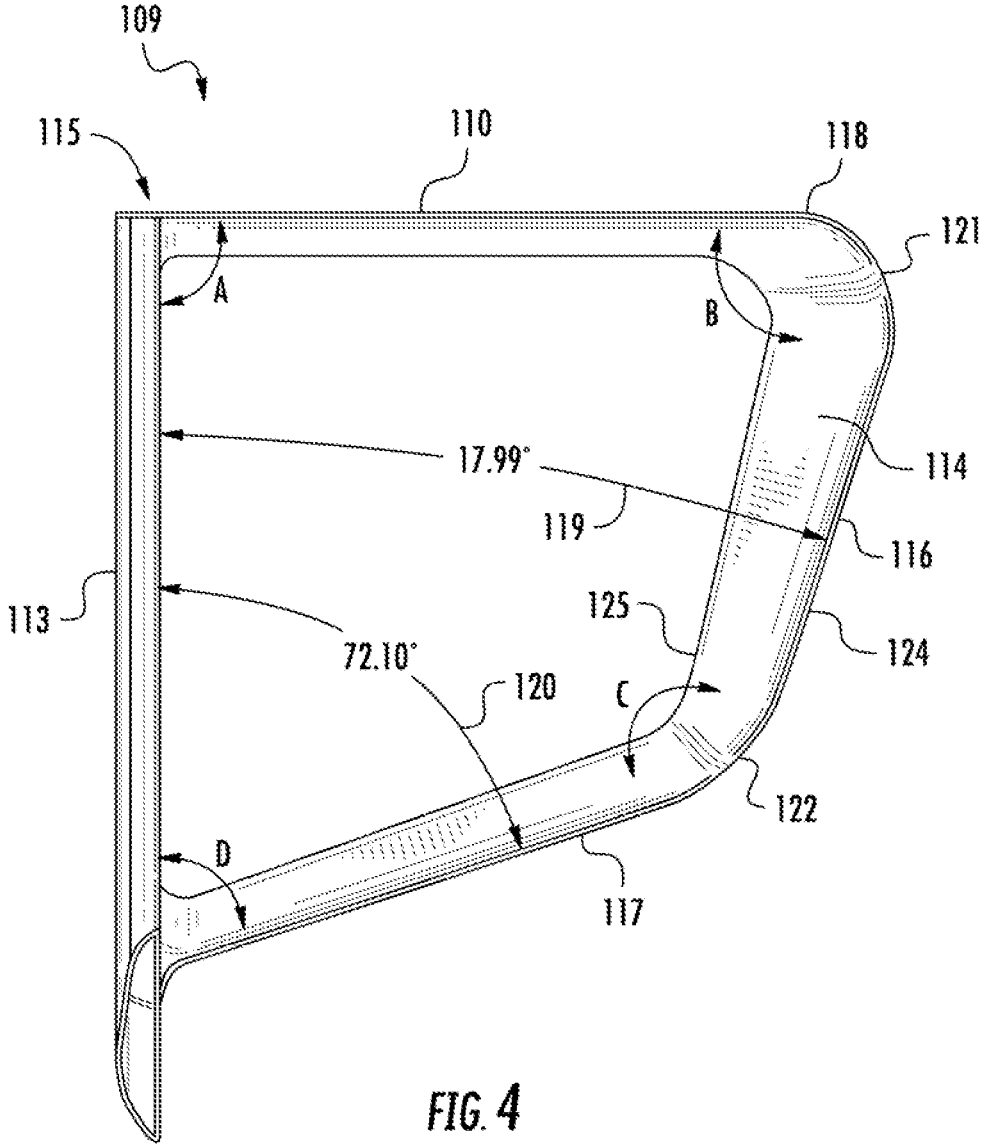
FIG. 4 shows a front view of the lifted fin shown in FIG. 2.
Figure 5:
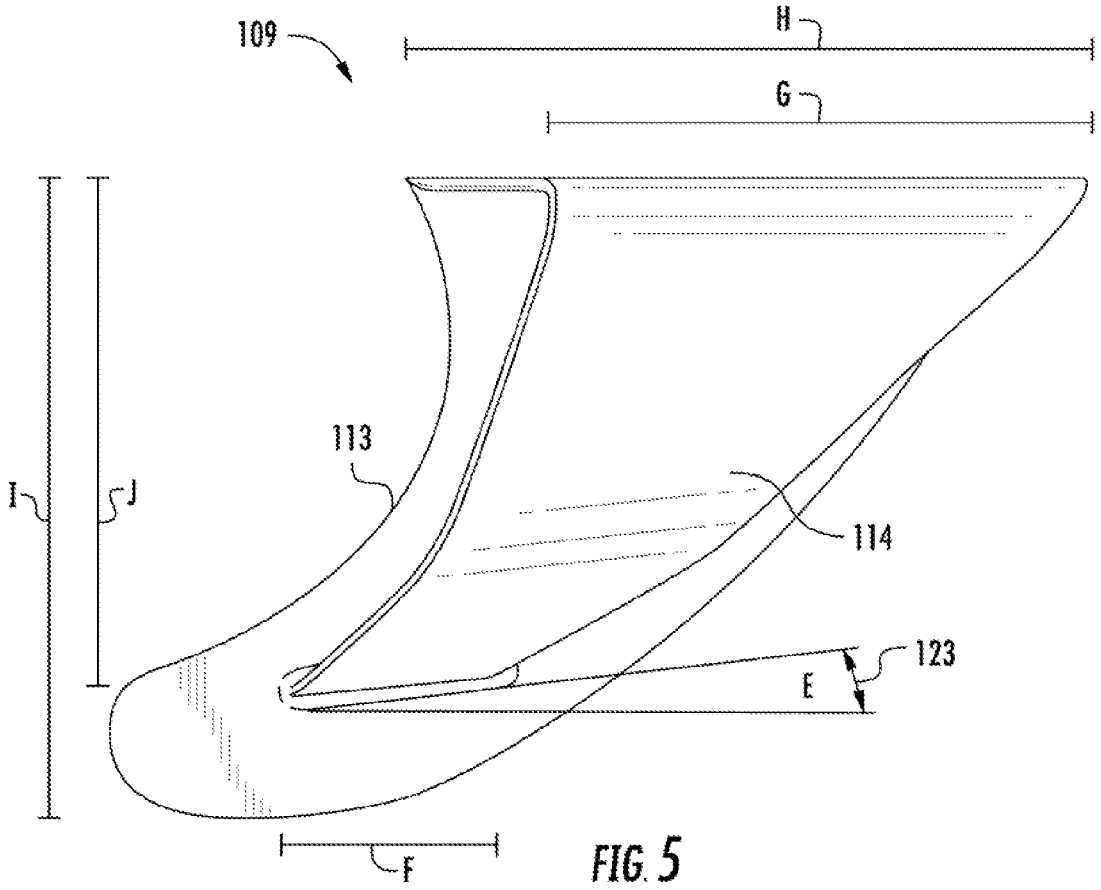
FIG. 5 shows a side view of the lifted fin shown in FIG. 2 viewed from the center line of the surfboard.

Turning to FIG. 4, a front view of the lifted fin element of FIG. 2 is shown. In FIG. 4, a first fin component 116 or in this case the top portion of second fin 114 extends downward at an angle of 17.99° 119 from the first fin 113 for a specified length and a second fin component 117 or in this case the lower portion extends downward at an angle of 72.10° 120 until the second fin 114 reaches and is mounted to the first fin 113 below the base member 110 point of attachment. In this embodiment, the relationship and engagement of first fin, base member, and second fin forms a "box" configuration, which will be described in more detail below. As mentioned previously, the junctions between first fin component 116 and base member 110 and between first fin component 116 and second fin component 117 form bends or elbows 121 and 122 respectively.

Additional lift vectors may be designed into the lifted fin elements 102, 103. For example, the first fin 113 may be attached to the second fin 114 at a specific angle to the horizontal wherein the edge of second fin 114 is slightly pitched downward from front to rear. In the embodiment shown in FIG. 5, the edge of second tin 114 at the attachment point to first fin 113 is pitched downward by 5.00° 123 (and "E") in relation to the horizontal or the plane of the water surface.

While the specific angles described in the preceding paragraphs were found to exhibit the best performance, it should be recognized by one of ordinary skill in the art that through experimentation other angles and dimensions were determined to yield positive result as well. For example, it was determined that the declined angle 123 shown in FIG. 5 may be between about 5.00° and 20.00°; however 5.00° was found to perform best for the intended purpose of the present invention. Other variations in certain lengths and angles designated as elements A-I in FIGS. 4 and 5 were also found. For example, the following dimensions were found to yield positive results through experimentation for elements A-I: A=80°-100°; B=50°-90°; C=0°-90°; D=40°-90°; E=5°-20°; F=0.5"-2.0"; G=3.5"-5.0"; H=3.5"-5.5"; I=3.5"-5.5"; and J=2.5"-5.0".

A lifted fin element may also be designed to create a "Venturi" effect by using a box frame opening or mouth that has a larger cross sectional area at points of water entry when compared to a cross sectional area at points of water discharge. For a constant mass flow rate of water passing through the box frame, the reduction in the Sifted fin interior cross sectional area forces water to travel a longer distance through the interior physical space. Given water's incompressible characteristic, and in consideration of the need for additional water velocity to keep up with the speed of the fins for a constant velocity, water pressure is reduced inside the box frame, i.e., the interior physical space. The reduction of water pressure by the Venturi effect produced within the box frame interior space tends to further reduce the water pressure over the top surface of the horizontal hydrofoil fin. With further reduction in water pressure over the hydrofoil fin's top "curved" surface, the upward force applied to the bottom of the hydrofoil fin is greater. The net effect is the production of additional lift for a constant fin velocity.

The differences in the surface area of the box design entry and exit openings may be modified to change overall pressure reduction experience inside the fin's zones of influence. Current design utilizes the Venturi effect through its lateral cross section normal to the direction of travel. An example of an implementation of a design of differences in a cross sectional area at points of water entry and a cross sectional area at points of water discharge is shown in FIG. 4, where line 124 represents a leading edge of the box frame and line 125 represents a trailing edge of the box frame.

Additionally, the lifted fin elements 102, 103 may be configured to produce hydrodynamic effects in conjunction, with each other when affixed to a surfboard as mirror images of one another on opposing sides of the bottom surface of the surfboard relative to the surfboard's longitudinal centerline. When compared to a single surfboard fin design, the symmetrical placement of two lifted fin elements, left and right, provides performance balance across the tail of the surfboard in addition to theoretically doubling the available lift force over a single element lifted fin design. Beyond lift force multiplication, the left and right lifted fin elements may also be designed to provide surfboard lift and speed enhancements through a combined and symbiotic effect.

For example, desired laminar flow characteristics may be enhanced for water volumes passing through the space between the left and right element interior feces. This is accomplished by the physical boundaries presented by the interior faces of each lifted fin element. The interior faces of the lifted fin elements and the bottom surface of the surfboard provide boundaries for a passage way that serves as a directional "aqueduct" as water passes through the system. Rotational adjustment of the left and the right elements provides opportunity for "tuning" "aqueduct" performance. For a particular direction of travel the Sifted fin elements may be adjusted such that theoretical "aqueduct" boundaries are "toed" to the right, or "toed" to the left, providing opposition to the tendency for gravity to drive the surfboard to the trough of a wave. The lifted fin elements may be adjusted such that they are "toed in," "toed out," or are in "parallel alignment." When "toed in," the lifted fin elements increase drag. When "toed out," the Venturi effect raises water velocity between the lifted fin elements increasing surfboard speed. When in "parallel alignment," the lifted fin elements help preserve laminar flow in the "aqueduct" and enhance the performance of the left and the right vertical wing and hydrofoil performance by mitigating turbulence.

Although the lifted fins elements 102, 103 are described in terms of separate components, one skilled in the art will, appreciate that a lifted fin elements may be manufactured as a single integrated component. Additionally, the lifted fin elements 102, 103 may be constructed utilizing a composite plastic selected to provide a balance between rigidity and flexibility. The selected material, and its design, is intended to provide structural rigidity under load while remaining flexible enough to enhance performance and sustain mechanical shock. The flexibility of the material enhances performance as velocity increases. The pressure inside the box frame is reduced with increased surfboard speeds. The net effect is that water pressure outside the box frame increases.

In general, lifted fin design considers all of the ultimate forces that are developed, particularly those that tend to "push" against relatively "flat" exterior faces of the vertical stabilizing elements. Vertical element design parameters include the integration, of "balanced surface areas" to minimize lateral differential pressure across the entire box frame that in turn mitigate lateral distortion under load. Also, the flexible properties of the composite plastic tend to absorb oscillation and flex slightly "inward" with the goal of enhancing the Venturi effect and providing an additional measure of lift.

As the "low point" of the vertical fin sections are pushed inward under load, the horizontal hydrofoil fin provides resistance to this "force of compression." Force of compression applied through vertical fin "low points" is opposed by the structural rigidity of the horizontal fin; the system tends to remain rigid when "squeezed" or "pushed" from both ends.

Conventional "inverted shark fin" designs, for surfboard "rudders" and "stabilizers." experience "flutter" as pressure conditions oscillate between their vertical faces under load. The box frame design of the lifted fins underneath a surfboard includes dimensional consideration aimed at an equitable distribution of pressure across the vertical members. When equitable pressure distribution is coupled with the inclusion of "low point" vertical wing stabilization offered by the connecting horizontal hydrofoil, fin "flutter" is nominal, producing smooth surfboard control as the rider provides input.

Virtually all performance gear experiences physical punishment when utilized under extreme conditions, The plastics selected for use in presenting the lifted fin physical form are chosen for their ability to remain rigid under load, yield predictable performance characteristics, and remain flexible enough to absorb mechanical shock during transport and use over a wide range of temperatures. Whether surfing a bulge in Arctic water originating from glacial collapse or a wave over a Hawaiian Island lava flow, the plastics chosen are designed to mitigate brittle fracture and heat deformation.

The foregoing description of an implementation has been presented for purposes of illustration and description. It is not exhaustive and does not limit the claimed inventions to the precise form disclosed. Modifications and variations are possible in Sight of the above description or may be acquired from, practicing the invention.

What is claimed is:

1. A lifted fin apparatus for attachment to the underside of a surfboard, the lifted fin apparatus comprising at least one lifted fin element wherein said lifted fin element comprises a base member having at least a first edge, a first fin mounted to the first edge of the base member, and a second fin comprising a first fin component and a second fin component, and a first elbow between base member and first fin component and a second elbow between first fin component and second fin component, wherein said second fin component is affixed to said first fin.

2. The lifted fin apparatus according to claim 1 wherein said apparatus comprises two lifted fin elements.

3. The lifted fin apparatus according to claim 1 wherein said first fin is substantially perpendicular to the first edge of the base member.

4. The lifted fin apparatus according to claim 1 wherein the angle between said first fin component and said first fin is about 17.99°.

5. The lifted fin apparatus according to claim 1 wherein the angle between said second fin component and said first fin is about 72.10°.

6. The lifted fin apparatus according to claim 1 wherein said second fin and. first fin are attached such that said second fin component is at a 5° descending plane in relation to the horizontal.

7. The lifted fin apparatus of claim 1 wherein said first fin, second fin, and base member form a box frame further comprising a front and rear opening wherein said front opening has a cross sectional area that is greater than said rear opening.

8. The lifted fin apparatus according to claim 1 wherein said first fin, base member, and second fin each comprise a lead edge and a rear edge and wherein the slope from the lead edge to the point of maximum thickness on the fin is substantially uniform and the slope from the rear edge to the point of maximum thickness on the fin is substantially uniform.

9. The lifted fin apparatus according to claim 1 wherein said first, fin, base member, and second fin each comprise a lead edge wherein the length, between, the lead edge of the first fin and second fin and the nearest point of maximum thickness on the fin is about 0.25 inches.

10. A lifted fin apparatus for attachment to the underside of a surfboard, the lifted fin apparatus comprising two lifted fin elements wherein said lifted, fin elements each further comprise a base member having a first edge and a second edge, a substantially vertical first fin affixed to the first edge of the base member with a convex face facing the outer edge of said surfboard, and a substantially angular second fin having a first edge, second edge, a first fin component and a second fin component, wherein first fin component extends from said second edge of base member at a predetermined angle to said first fin and said second fin component extends from said first fin component at predetermined angle to said first fin and wherein said first edge of the second fin is affixed to the second edge of the base member and the second edge of the second fin is affixed to the first fin below the base member.

11. The lifted fin apparatus according to claim 10 said first fin comprising a convex first face and a second face wherein said first face is oriented toward the exterior edge of the surfboard.

12. The lifted fin apparatus according to claim 10 said second fin component of said second fin comprising a convex first face and a second face wherein said first face is oriented toward the base member.

13. The lifted fin apparatus according to claim 10 wherein the predetermined angle between said first fin component and said first fin is about 17.99°.

14. The lifted fin apparatus according to claim 10 wherein the predetermined angle between said second fin component and said first fin is about 72.10°.

15. The lilted fin apparatus according to claim 10 wherein said second fin and first fin are attached such that said second fin component is at a 5° descending plane in relation to the surface of the water.

16. The lifted fin apparatus according to claim 10 wherein said first fin, base member, and second fm each comprise a lead edge and a rear edge and wherein the slope from the lead edge to the point of maximum thickness on the fin is substantially uniform and the slope from the rear edge to the point of maximum thickness on the fin is substantially uniform.

17. The lifted fin apparatus according to claim 10 wherein said first fin, base member, and second fin each comprise a lead edge wherein, the length between the lead edge of the first, fm and second fin and the nearest point of maximum thickness on the fin is about 0.25 inches.

18. The lifted fin apparatus of claim 10 wherein said first fin, second fin, and base member form a box frame further comprising a front and rear opening wherein said first opening has a cross sectional area that is greater than said second opening.

19. A method of achieving surfboard lift comprising the steps of attaching at least one lifted fin element to the underside of a surfboard said lifted fin element comprising a base member having at least a first edge, mounting a first fin to the first edge of the base member, and mounting a second fin comprising a first fin component and a second fin component, and a first elbow between base member and first fin component and a second elbow between first fin component and second fin component, and adjusting a plug system of the lifted fin element to the desired performance of the user.

* * * * *